US006662816B1

(12) United States Patent
Cunningham

(10) Patent No.: US 6,662,816 B1
(45) Date of Patent: Dec. 16, 2003

(54) CANOPY VENT

(76) Inventor: George C. Cunningham, 970 Robin Hood Dr., Punta Gorda, FL (US) 33982

( * ) Notice: Subject to any disclaimer, the term of this patent is extended or adjusted under 35 U.S.C. 154(b) by 31 days.

(21) Appl. No.: 10/172,584

(22) Filed: Jun. 17, 2002

(51) Int. Cl.[7] ..... E04H 15/16
(52) U.S. Cl. ..... 135/94; 135/93; 52/198; 454/364; 454/365
(58) Field of Search ..... 135/94, 93, 33.7; 52/198; 454/364, 365

(56) References Cited

U.S. PATENT DOCUMENTS 38,419 A * 8/1863 Moakly
640,582 A * 1/1900 Munson
3,380,370 A * 4/1968 Mack
5,433,663 A * 7/1995 Henningsson et al.

* cited by examiner

*Primary Examiner*—Robert Canfield
(74) *Attorney, Agent, or Firm*—Frank A. Lukasik

(57) ABSTRACT

A covered vent for a tent or canopy consisting of a series of cutouts along the ridge line of a canopy and having a screen fastened to cover the cutouts, a flap fastened to the canopy at one side by stitching and covering the cutouts, and having a series of ties fastened along the length of the second side of the flap, the ties being fastened to the canopy to provide a limited opening to permit air flow when large gusts of air are present and closing when the air gusts are diminished.

1 Claim, 8 Drawing Sheets

CANOPY VENT

BACKGROUND OF THE INVENTION

The present invention relates to canopies and air vents to reduce air pressure which may cause the canopy to blow away and, more particularly, to a covered vent with a movable flap which raises to allow air to escape and falls back in place to reseal the vent.

Canopies and tents are essentially bags into which wind can enter causing them to become unstable. To prevent this, vents have long been used to allow air to spill thereby reducing the air pressure on the underside of the covering. Vents, by their nature, are open all the time and are subject to leakage during rain storms. A variety of prior art tents and canopies have double layers separated by ribs to allow air to circulate and, while this is an effective system for venting, it requires extra material and construction is involved and costly. The present invention is simply and cheaply constructed, can be installed at the time of manufacture or could be retro-fitted to existing tents and canopies as a vent kit.

The present invention consists of a series of rectangular holes placed along the apex of a tent or canopy. A hinged and tethered flap overlays these holes and moves away to allow moving air to vent from beneath. As the air slows, the flap returns to cover the holes. Longitudinal stitching along one edge of the flap forms the hinge and secures the flap to the canopy/tent. A parallel series of eyelets are fitted with ties so as to restrain the flap at a fixed angle of deployment. Toggles or small weights attached to each tie keep the flap closed until air pressure is again sufficient to lift it against the weight of the toggles. A screen material can be sewn in place beneath the flap to give it support against sagging into the openings and to exclude insects, leaves etc.

SUMMARY OF THE INVENTION

A primary object of the present invention is to provide a means for constructing or modifying a canopy or tent with a series of sealing ridge vents to allow air to escape.

A further object of the invention is to provide means for securing a flap over these vents so that air movement can lift the flap away from the vent, allow air pressure within to reduce, and return to once again cover the vent holes.

A further object of the invention is to provide toggled ties by which the flap can be constrained to a limited distance of travel away from the vents and returned to its original sealing position over the vents.

A further object of the invention is to provide a screen over the vents to keep out insects and debris.

DETAILED DESCRIPTION OF A PREFERRED EMBODIMENT

Figure 1:
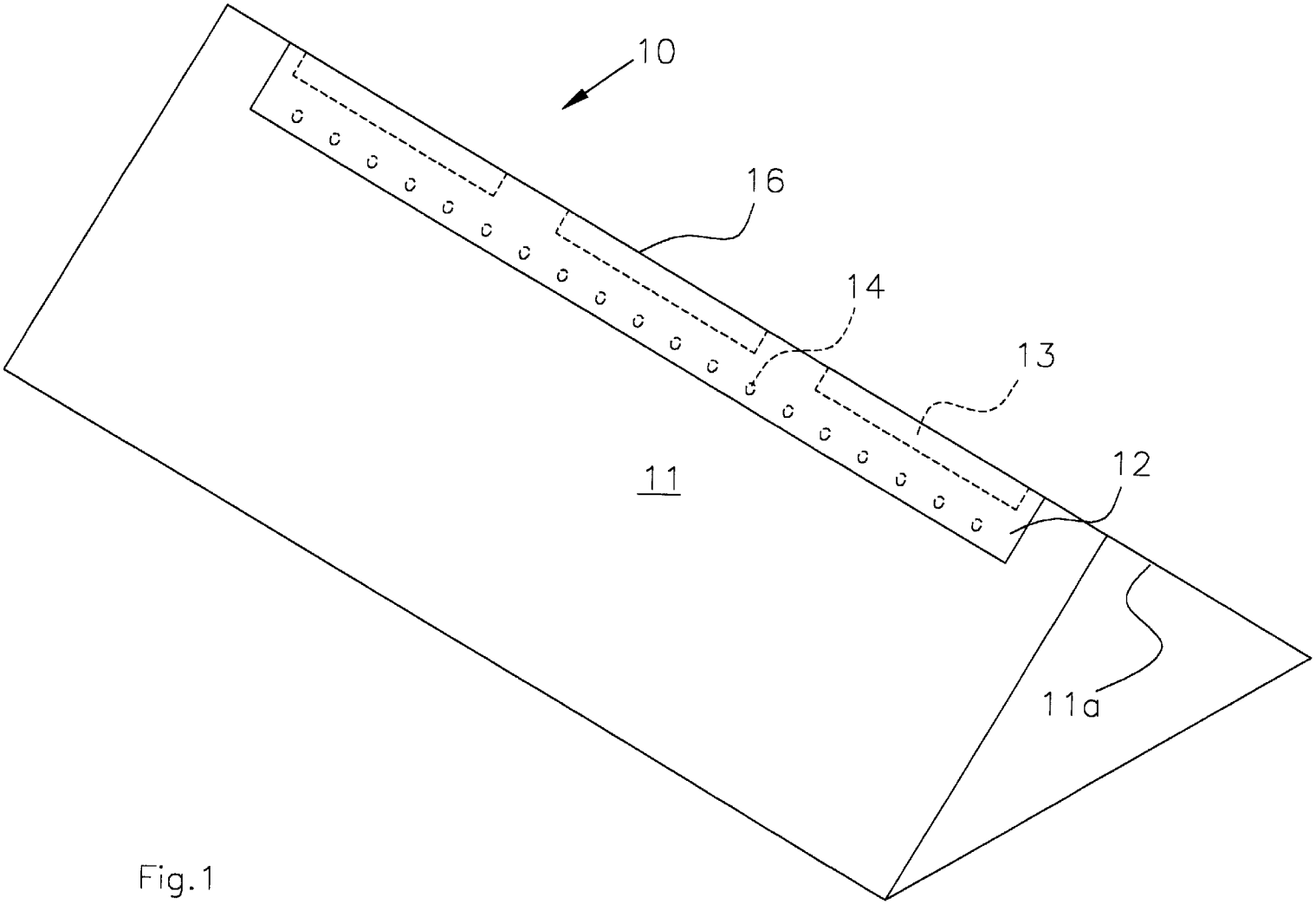
FIG. 1 is an isometric view partially in broken line section of the invention showing the flap/vent combination along the apex of a canopy.
Figure 2:
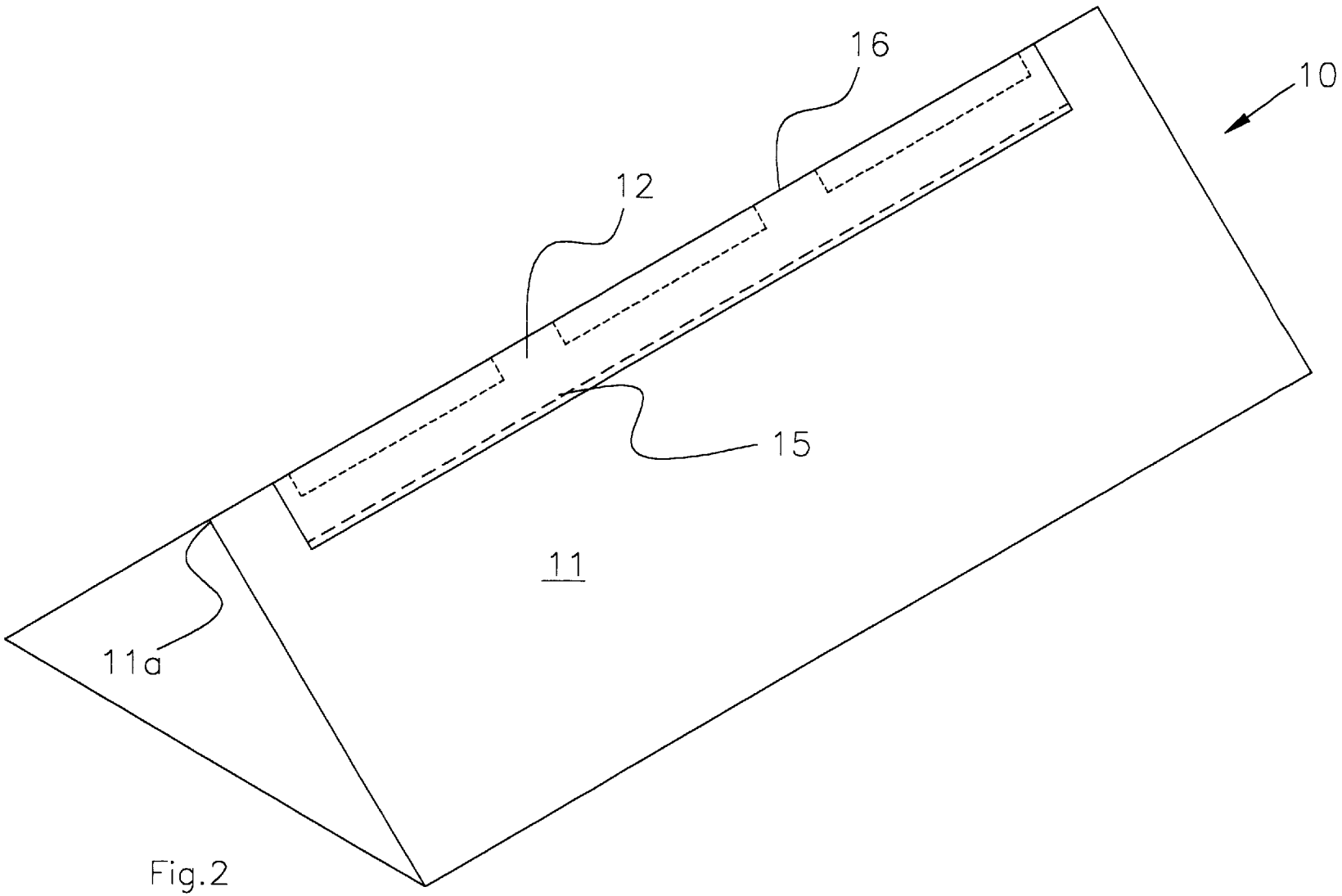
FIG. 2 is an isometric view partially in broken line section of the invention showing the flap/vent combination along the apex of a canopy.

Referring now to the drawings wherein like numerals designate like and corresponding parts throughout the several views, the invention is designated overall by the numeral 10. In FIG. 1 canopy 11 has an underside 11*a*. Ridge center 16 has cutouts 13. Flap 12 overlies cutouts 13. Ties 14 keep flap 12 in position. In FIG. 2, stitching 15 attaches flap 12 to canopy 11.

Figure 3:
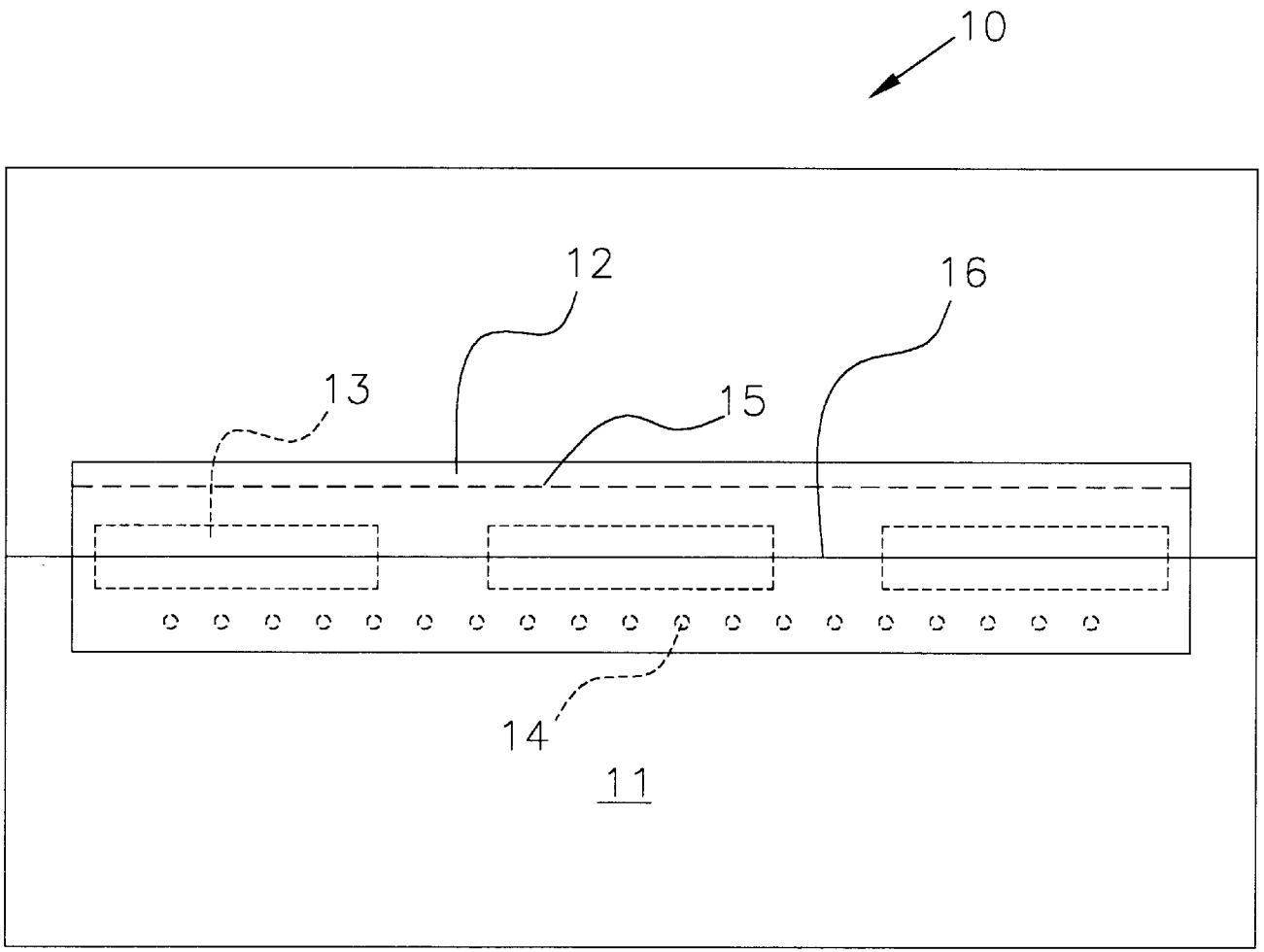
FIG. 3 is a plan view partially in broken line section of the invention.
Figure 4:
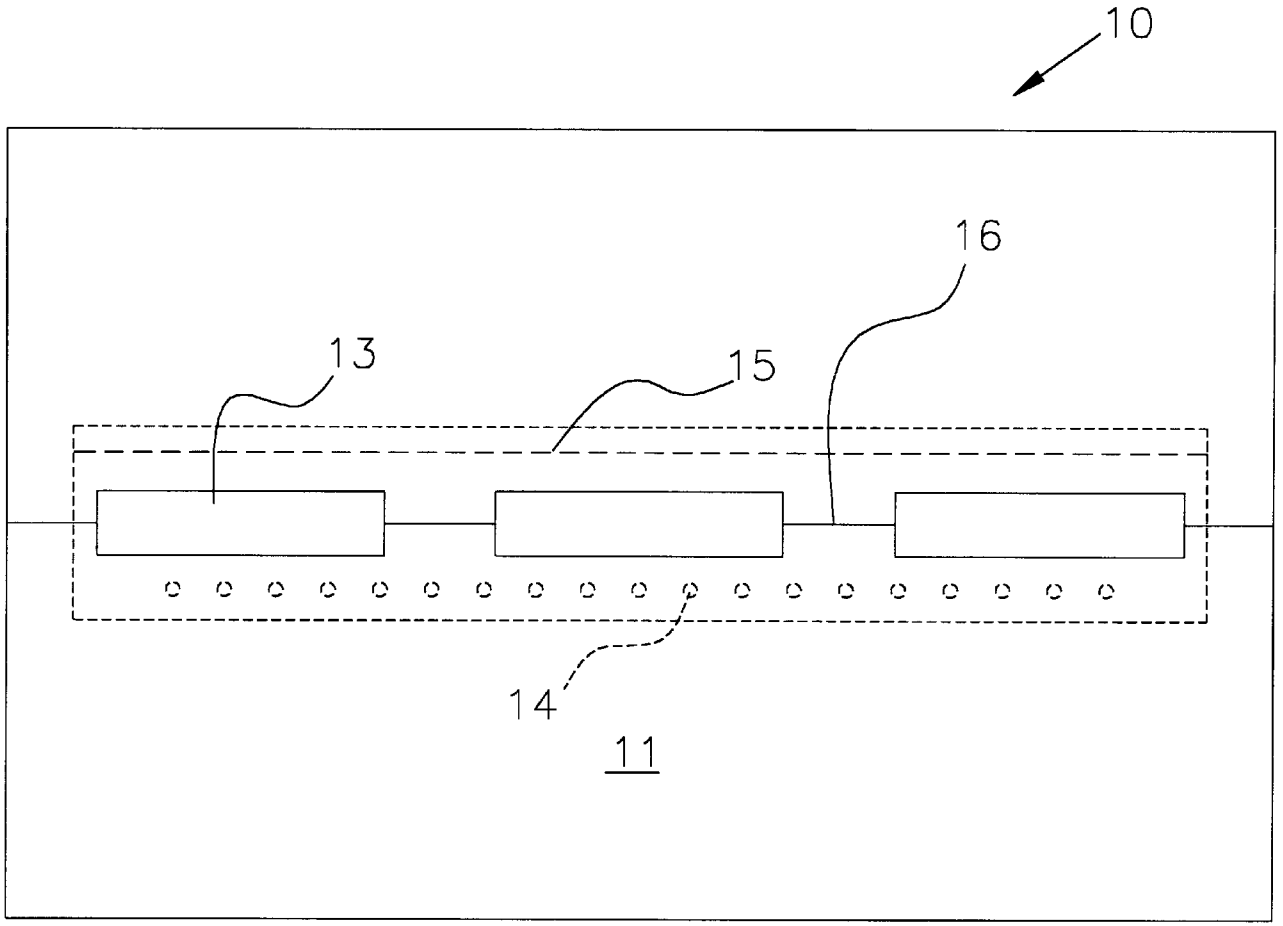
FIG. 4 is a plan view partially in broken line section of the invention.

Referring now to FIGS. 3 and 4, cutouts 13 span from center ridge 16 into canopy 11 forming thereby openings for air to escape. Flap 12 covers cutouts 13 and is attached by stitching 15 on one side and restrained by ties 14 on the other.

Figure 5:
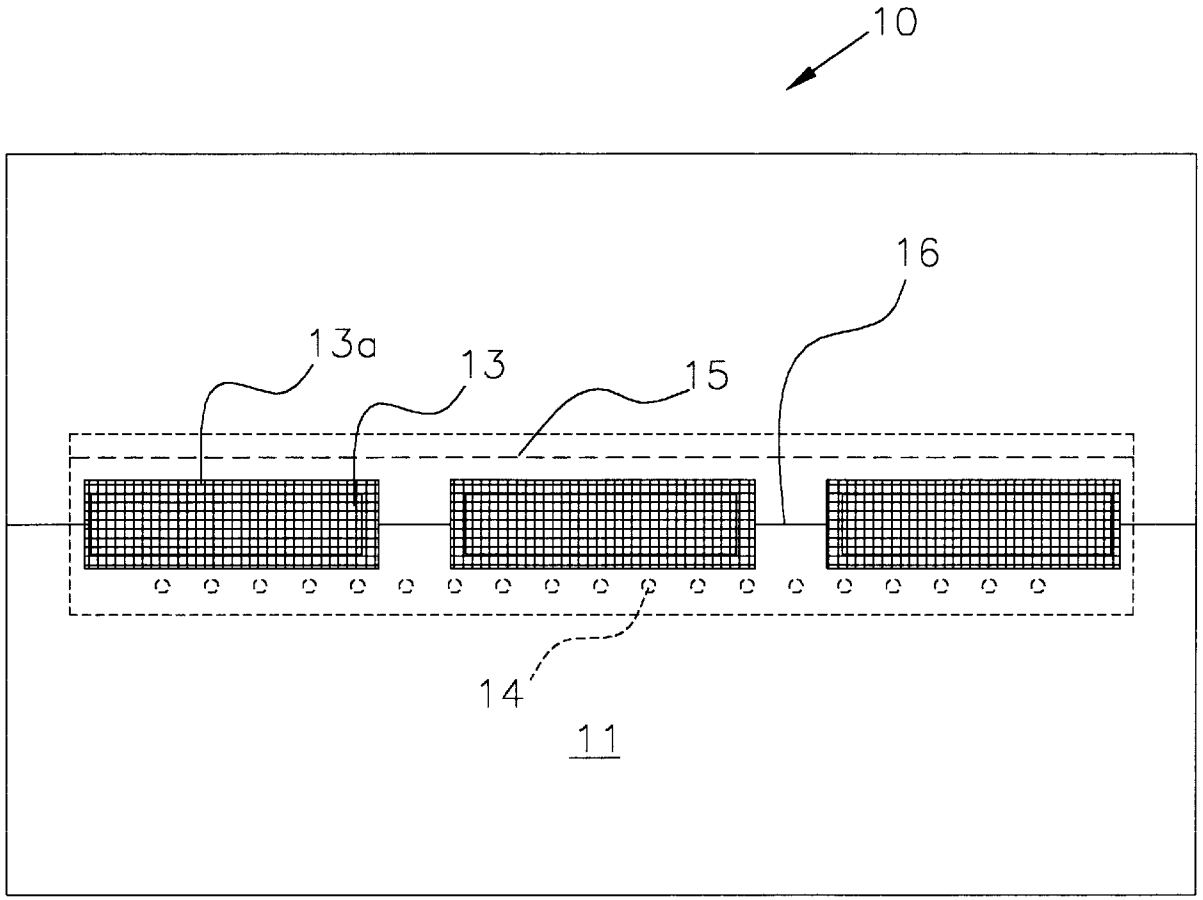
FIG. 5 is a plan view partially in broken line section of the invention.

In FIG. 5, screen 13*a* provides protection for opening 13.

Figure 6:
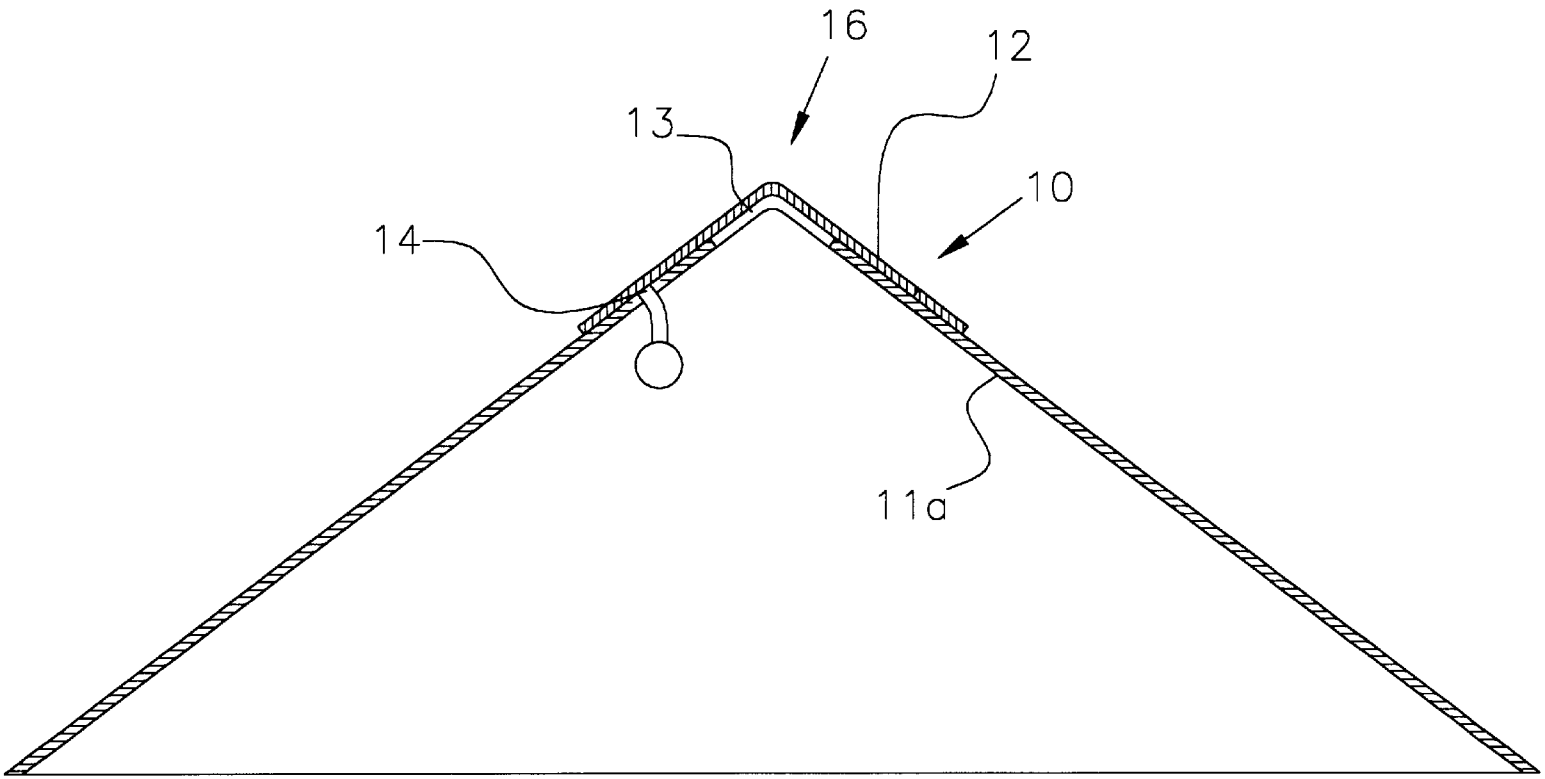
FIG. 6 is an end elevational view partially in section of the invention showing the flap in a closed position.
Figure 7:
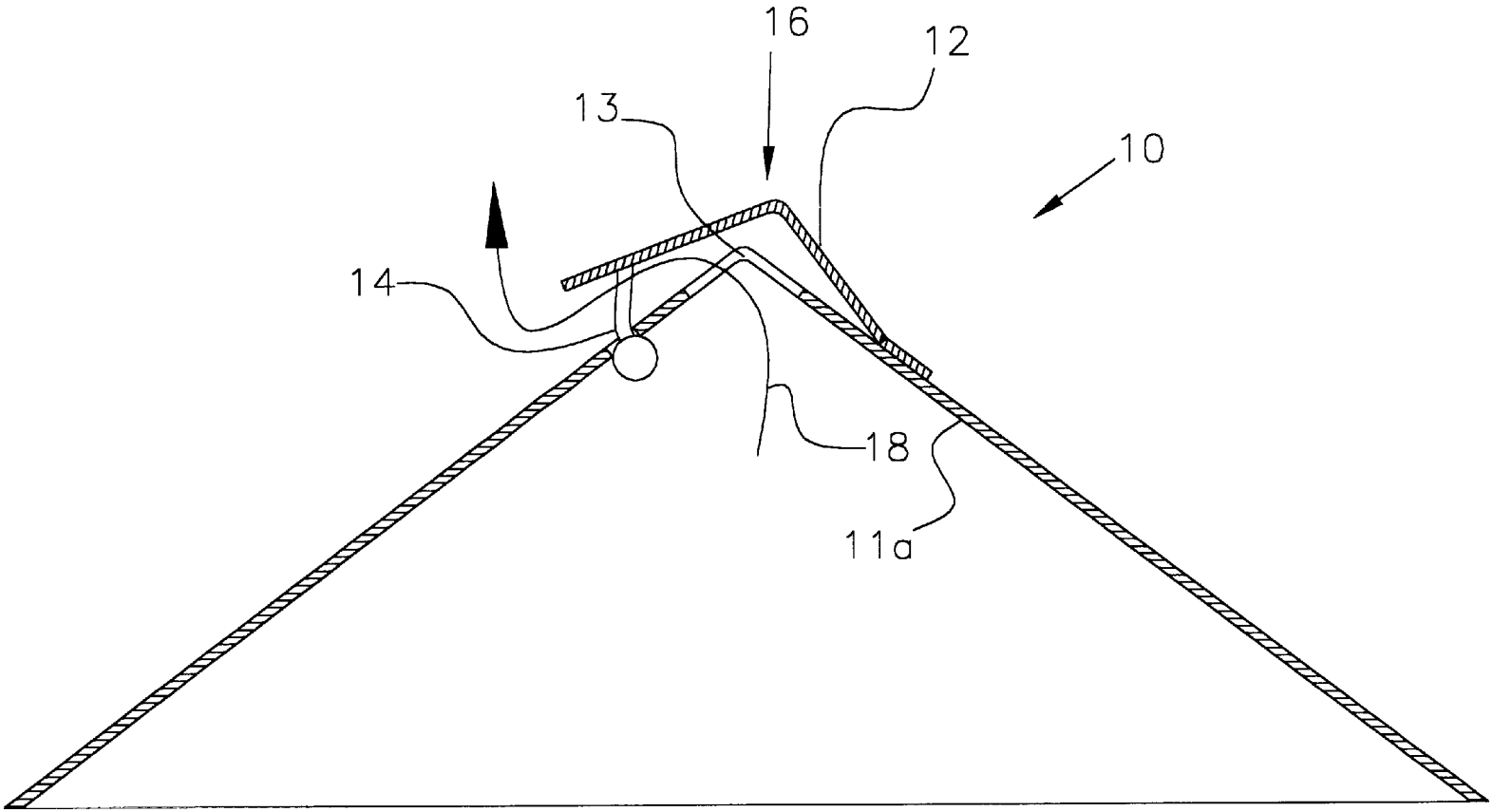
FIG. 7 is an end elevational view partially in section of the invention showing the flap in an open position.
Figure 8:
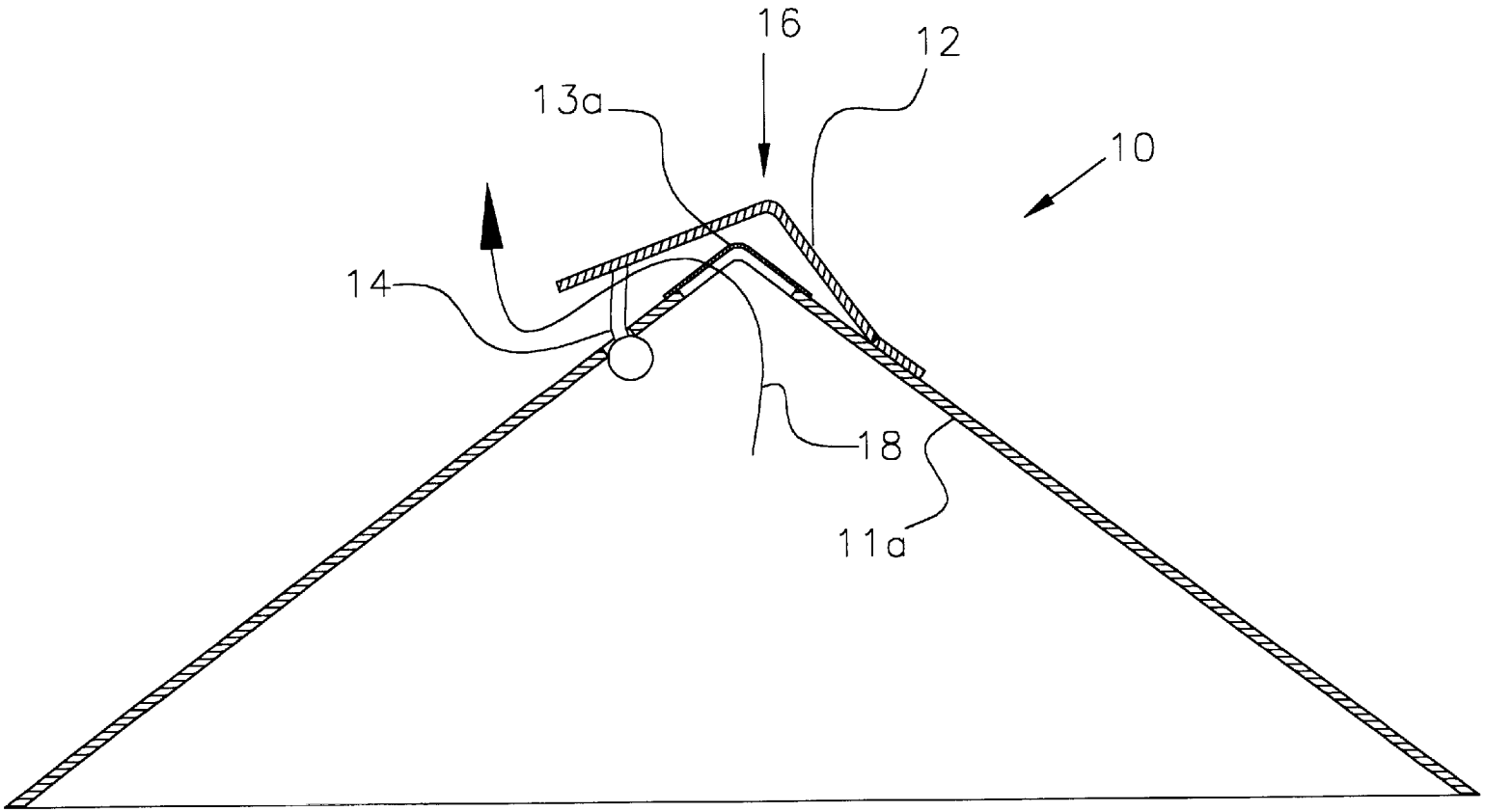
FIG. 8 is an end elevational view partially in section of the invention showing the flap in an open position and a screen over the vent hole.

In FIG. 6, flap 12 is closed, held down by ties 14. Cutout 13 is covered. Flap 12 forms a cover to complete underside 11*a*. In FIG. 7, flap 12 is raised and is constrained by tie 14. Air 18 can flow through cutout 13 thereby relieving pressure on underside 11*a*. FIG. 8 has screen 13*a* added beneath flap 12.

What is claimed is:

1. A covered vent for a canopy having a center ridge, said covered vent comprising:

a canopy having a first end and a second end, and a selected plurality of rectangular cutouts spanning the center ridge into said center ridge, said cutouts being axially aligned to said center ridge, said cutouts beginning at a point near said first end and ending at a point near said second end, a screen attached across each of said rectangular cutouts, a flap having a first side and a second side, said flap fastened at a first side to said canopy by stitching, said flap running from a point near said first end and ending at a point near said second end, said flap being sufficiently long to cover each of said cutouts along the length of said center ridge, a plurality of ties fastened along the length of said second side of said flap and movably attached to said canopy, thereby restricting the motion of said flap to open to permit air flow and to cover said cutouts when the air flow diminishes.

* * * * *